US008682240B2

(12) United States Patent
Fukita et al.

(10) Patent No.: US 8,682,240 B2
(45) Date of Patent: Mar. 25, 2014

(54) IMAGE FORMING APPARATUS

(75) Inventors: Taku Fukita, Mishima (JP); Minoru Kawanishi, Yokohama (JP); Kenji Watanabe, Suntou-gun (JP); Motohiro Furusawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 445 days.

(21) Appl. No.: 12/719,215

(22) Filed: Mar. 8, 2010

(65) Prior Publication Data

US 2010/0254721 A1 Oct. 7, 2010

(30) Foreign Application Priority Data

Apr. 1, 2009 (JP) ..... 2009-089274
Mar. 1, 2010 (JP) ..... 2010-044330

(51) Int. Cl.
*G03G 15/00* (2006.01)

(52) U.S. Cl.
USPC ..... 399/405; 271/211

(58) Field of Classification Search
USPC ..... 399/44, 405; 271/211
See application file for complete search history.

(56) References Cited

U.S. PATENT DOCUMENTS 4,405,125 A * 9/1983 Kulpa et al. ..... 271/195
6,527,267 B1 3/2003 Kuwata et al.
6,643,480 B2 11/2003 Kuwata et al.
6,830,245 B2 12/2004 Matsushima et al.
6,832,066 B2 12/2004 Watanabe et al.
2003/0193125 A1* 10/2003 Saegusa et al. ..... 270/58.08
2006/0093420 A1* 5/2006 Oba ..... 399/405
2007/0196152 A1 8/2007 Shimizu et al.
2008/0202302 A1 8/2008 Hayashi et al.
2009/0066009 A1 3/2009 Matsushima et al.
2009/0134563 A1 5/2009 Watanabe et al.

FOREIGN PATENT DOCUMENTS

JP 04-044251 4/1992
JP 2006-103849 4/2006
JP 2008-273681 11/2008

* cited by examiner

*Primary Examiner* — Benjamin Schmitt
(74) *Attorney, Agent, or Firm* — Fitzpatrick, Cella, Harper & Scinto

(57) ABSTRACT

A printer includes a fixing device that fixes a toner image formed on a sheet and a sheet delivery roller pair for delivering the sheet on which the toner image is fixed by the fixing device onto a sheet delivery tray placed outside of a printer main body. The printer includes a supporting member that supports an upstream edge portion of the sheet in a delivery direction delivered from the sheet delivery roller pair so that the upstream edge portion does not fall down on the sheet delivery tray. The printer includes a blower unit that blows air along a lower surface of the sheet supported by the supporting member from the upstream edge portion of the sheet in the delivery direction toward a downstream edge portion of the sheet in the delivery direction.

8 Claims, 10 Drawing Sheets

IMAGE FORMING APPARATUS

BACKGROUND OF THE INVENTION

1. Field of the Invention

The present invention relates to an image forming apparatus such as a copier, a printer, and a facsimile machine, and more particularly, to an image forming apparatus that suppresses mutual adhesion of delivered sheets.

2. Description of the Related Art

Conventionally, there is known an image forming apparatus, such as a copier, a printer, and a facsimile machine, which uses an electrophotographic process and an electrostatic recording process. In the image forming apparatus of this type, an electrostatic latent image formed on a photosensitive drum serving as a latent image bearing member is subjected to a development process. Then, an unfixed toner image is formed on a sheet (transfer sheet, print sheet, photosensitive sheet, electrostatic recording sheet, or the like) by a transfer method or a direct method. Then, the toner image is fixed onto the sheet under the action of pressure and heat by a fixing device according to a variety of methods and configurations, which include a heat roller method, a film heating method, and an electromagnetic induction heating method. The sheet, on which the toner is fixed, is delivered by a pair of sheet delivery rollers to a sheet delivery tray thereafter, and is stacked thereon. At the time when the toner-fixed sheet is stacked on the sheet delivery tray, as measures against mutual adhesion and image deterioration of the sheets due to the toner affected by the heat, there is proposed an image forming apparatus which cools an upstream edge portion (hereinafter, referred to as a trailing edge portion), in a sheet delivery direction, of the stacked sheet on the sheet delivery tray (refer to US 2007/0196152). FIG. 10 illustrates a sheet delivery tray 301 of the conventional image forming apparatus.

On a wall surface of the sheet delivery tray 301, which is located upstream in the sheet delivery direction, multiple opening portions 302 are provided in a stack direction (height direction) of the sheets. The opening portions 302 allow air to be taken in, and enable contact between the sheets and the air. The air is fed along trailing edges of the stacked sheets, and cools the trailing edge portions of the stacked sheets.

As another cooling method, there is proposed a method in which the sheet, which is being delivered by a pair of sheet delivery rollers, is cooled by blowing air to a lower surface of the sheet (refer to Japanese Utility Model Application Laid-Open No. H04-44251). FIG. 11 illustrates an image forming apparatus including a conventional blower fan. As illustrated in FIG. 11, a blower fan 402 is installed between a pair of sheet delivery rollers 400 and a sheet delivery tray 401. Accordingly, the blower fan 402 blows the air to a lower surface of a sheet S, which is being delivered by the pair of sheet delivery rollers 400, and cools the lower surface of the sheet S which is passing above the blower fan 402.

In the conventional cooling method described above, when a sheet delivery speed is increased along with a speed-up of the image forming, the sheets are stacked one after another in a heat-accumulated state of not being cooled sufficiently. When the sheets are not cooled sufficiently, the sheets stacked on the sheet delivery tray are more likely to adhere to each other.

To be more specific, in the image forming apparatus illustrated in FIG. 10, the air is blown to the trailing edges of the sheets stacked on the sheet delivery tray. When the sheet delivery speed is increased, the sheets are stacked one after another before surfaces of the sheets, which are opposite to each other, are cooled sufficiently. As a result, such a state is brought where the heat is accumulated between the sheets, and accordingly, it is difficult to obtain a sufficient cooling effect, and the sheets are more likely to adhere to each other.

In the image forming apparatus illustrated in FIG. 11, when the sheet delivery speed is increased along with the speed-up of the image forming, a time during which each of the sheets passes through a blowing position of the blower fan is also shortened, and the sheets which are not cooled sufficiently are stacked on the sheet delivery tray one after another. As a result, the sheets stacked on the sheet delivery tray are more likely to adhere to each other.

SUMMARY OF THE INVENTION

It is an object of the present invention to provide an image forming apparatus that suppresses mutual adhesion of sheets stacked on a sheet delivery tray, and may suppress deterioration of image quality.

An image forming apparatus according to the present invention includes: an image forming unit that forms a toner image on a sheet; a fixing unit that fixes the toner image formed on the sheet by heat; a sheet delivery unit that delivers the sheet on which the toner image is fixed onto a sheet delivery tray; a supporting member that supports an upstream edge portion of the delivered sheet in a delivery direction before the upstream edge portion of the sheet in the delivery direction falls down on the sheet delivery tray, the supporting member being placed between the sheet delivery unit and a sheet stacking surface of the sheet delivery tray; and a blower unit that blows air along a lower surface of the sheet supported by the supporting member; a moving unit that moves the supporting member between a first position to support the upstream edge portion of the sheet in the delivery direction and a second position to release the upstream edge portion of the sheet in the delivery direction and cause the sheet to fall down; and a controller that controls the moving unit.

According to the present invention, in a state where the sheet is supported by the supporting member, the blower unit blows the air along the lower surface of the sheet from the upstream edge portion of the sheet in the delivery direction toward the downstream edge portion thereof in the delivery direction. Therefore, the entire plane of the sheet may be cooled effectively. By the time when the sheet cooled by the blower unit falls down to be stacked on the sheet delivery tray, the sheet is sufficiently cooled. Therefore, the mutual adhesion of the sheets may be suppressed, and the deterioration of the quality of the image formed on the sheet may be suppressed.

Further features of the present invention will become apparent from the following description of exemplary embodiments with reference to the attached drawings.

BRIEF DESCRIPTION OF THE DRAWINGS

FIGS. 2A and 2B are explanatory views of principal portions of the printer, illustrating operations of delivering a sheet, of which FIG. 2A illustrates a state where a supporting member is moved to a first position, and FIG. 2B illustrates a state where the supporting member is moved to a second position.

FIGS. 3A and 3B are explanatory views of the state where the supporting member is moved to the first position, of which FIG. 3A is a partial perspective view of a state where the principal portions are cut, and FIG. 3B illustrates a state where the supporting member is moved to the first position by a moving mechanism.

FIGS. 4A and 4B are explanatory views of the state where the supporting member is moved to the second position, of which FIG. 4A is a partial perspective view of a state where the principal portions are cut, and FIG. 4B illustrates a state where the supporting member is moved to the second position by the moving mechanism.

FIGS. 9A, 9B, 9C and 9D are explanatory views illustrating a supporting unit of a sixth embodiment according to the present invention, of which FIG. 9A is an explanatory view illustrating operations of delivering the sheet, FIG. 9B is an explanatory view of a supporting member, FIG. 9C is an explanatory view of a pressing member, FIG. 9D is an explanatory view of a supporting member of another embodiment.

DESCRIPTION OF THE EMBODIMENTS

Figure 1:
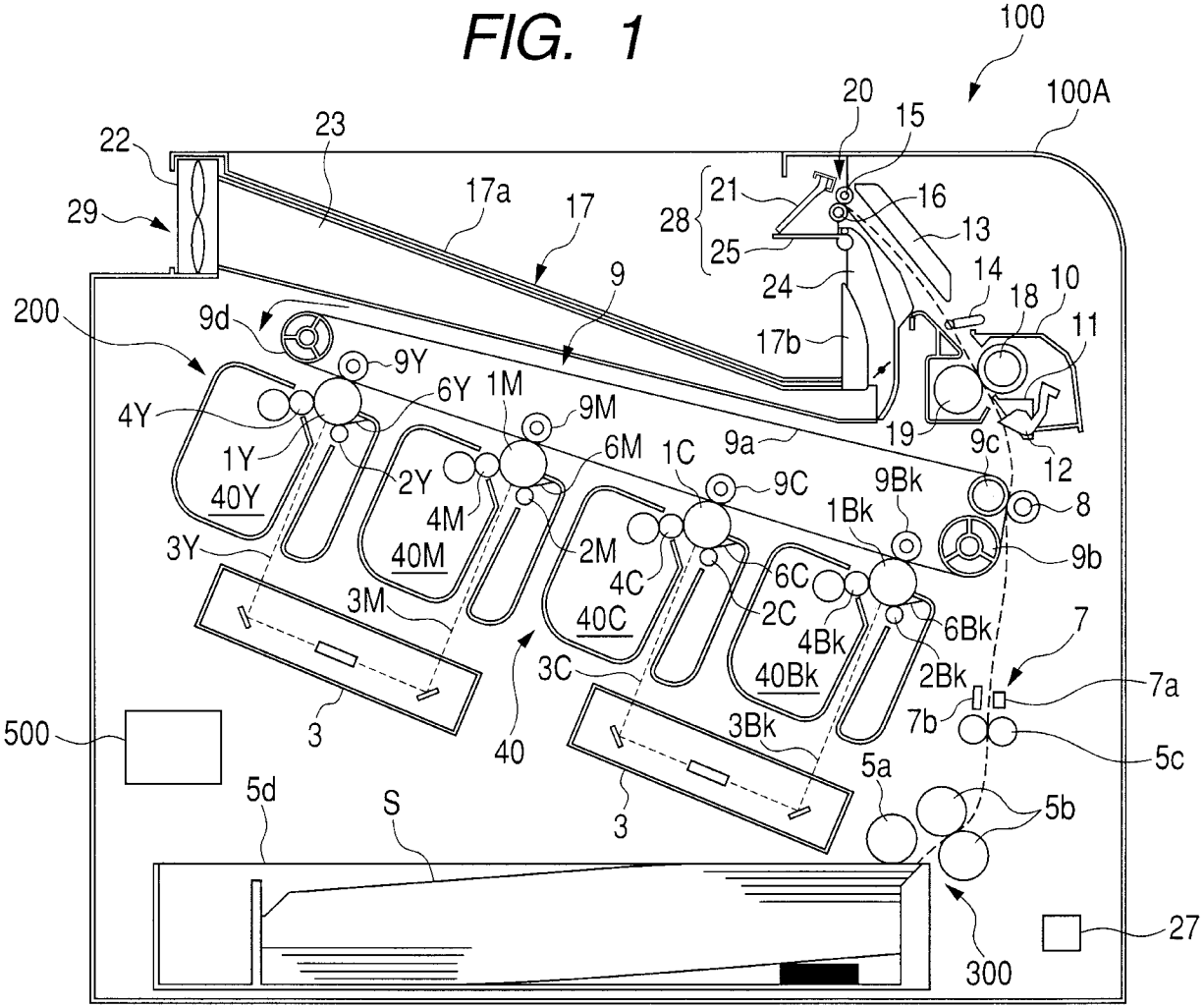
FIG. 1 is an explanatory view illustrating a schematic configuration of a tandem laser beam printer using a transfer electrophotographic process as an example of an image forming apparatus according to a first embodiment.

Embodiments for carrying out the present invention are described below in detail while referring to the drawings.

First Embodiment

FIG. 1 is an explanatory view illustrating a schematic configuration of a tandem laser beam printer using a transfer electrophotographic process as an example of an image forming apparatus according to a first embodiment. In the following description, upstream edge portions of sheets in a sheet delivery direction (upstream edge portions in a conveying direction) are referred to as trailing edge portions, and downstream edge portions of the sheets in the sheet delivery direction (downstream edge portions in the conveying direction) are referred to as leading edge portions.

A color laser beam printer 100 (hereinafter, referred to as a printer) is an image forming apparatus, and a printer main body 100A is an apparatus main body. The printer 100 includes an image forming unit 200 as an image forming unit for forming toner images on sheets S, and a sheet feeding unit 300 for feeding the sheets S to the image forming unit 200. The printer 100 further includes a fixing device 10 as a fixing unit for fixing the toner images formed on the sheets S in the image forming unit 200.

The image forming unit 200 includes four process cartridges 40 (40Y, 40M, 40C, 40Bk) arrayed so as to correspond to four colors of yellow (Y), magenta (M), cyan (C), and black (Bk). The image forming unit 200 further includes scanner units 3 placed below the process cartridges 40, and an intermediate transfer unit 9 placed above the process cartridges 40 so as to be opposite to the process cartridges 40.

The process cartridges 40Y, 40M, 40C, and 40Bk respectively include photosensitive drums 1Y, 1M, 1C, and 1Bk which are respectively placed so as to be rotatable, primary chargers 2Y, 2M, 2C, and 2Bk and developing devices 4Y, 4M, 4C, and 4Bk which house toners of the respective colors therein. Furthermore, the process cartridges 40Y, 40M, 40C, and 40Bk respectively include cleaning units 6Y, 6M, 6C, and 6Bk.

The photosensitive drums 1 rotate clockwise by drum motors (direct current servo motors, not shown) in response to image forming operations. The photosensitive drums 1 are exposed by the scanner units 3, whereby electrostatic latent images are formed on surfaces thereof. Each of the photosensitive drums 1 is configured, for example, in such a manner that an organic photoconductive layer (OPC photosensitive body) is applied on an outer circumferential surface of an aluminum cylinder with a diameter of 20 to 30 mm.

The intermediate transfer unit 9 includes an endless intermediate transfer belt 9*a* in contact with the respective photosensitive drums 1, and primary transfer rollers 9Y, 9M, 9C, and 9Bk which are placed in an inside of the intermediate transfer belt 9*a* so as to be opposite to the respective photosensitive drums 1 while sandwiching the intermediate transfer belt 9*a* therebetween. The intermediate transfer unit 9 further includes a drive roller 9*b*, an opposing secondary transfer roller 9*c*, and a tension roller 9*d*, which are placed inside the intermediate transfer belt 9*a*. The intermediate transfer belt 9*a* is looped around the drive roller 9*b*, the opposing secondary transfer roller 9*c*, and the tension roller 9*d*. At a position opposite to the opposing secondary transfer roller 9*c* across the intermediate transfer belt 9*a*, a secondary transfer roller 8 is placed. The intermediate transfer belt 9*a* and the secondary transfer roller 8 form a transfer nip portion.

The sheet feeding unit 300 includes a cassette 5*d* for housing the sheets S therein, a pickup roller 5*a*, and a feed/retard roller pair 5*b*. A registration roller pair 5*c* is placed downstream of the sheet feeding unit 300 in the sheet conveying direction, that is, upstream of the transfer nip portion in the sheet conveying direction. The fixing device 10 is placed downstream of the transfer nip portion in the sheet conveying direction. The fixing device 10 fixes the transferred toner images onto the sheets S, and includes a heating roller 19 for heating the sheets S and a pressure roller 18 for bringing the sheets S into press contact with the heating roller 19. The pressure roller 18 and the heating roller 19 form a fixing nip portion.

The pressure roller 18 is connected to a drive unit (not shown), and is rotationally driven thereby. The heating roller 19 includes a heater as a heating source. A sheet guide 11 and a loop amount detection unit 12 are placed upstream of the fixing device 10 in the sheet conveying direction. The sheet guide 11 guides the leading edge portions of the sheets S to the fixing nip portion of the fixing device 10, and the loop amount detection unit 12 detects a case where a loop amount of each of the sheets S is a predetermined amount or more. The loop amount detection unit 12 includes a sensor lever and a photointerrupter. The loop amount detection unit 12 detects whether or not the loop amount of the sheet S, which is formed between the transfer nip portion and the fixing nip portion, is the predetermined amount or more. Based on detection results of the loop amount detection unit 12, a rotation speed of the pressure roller 18 of the fixing device 10 is varied, to thereby convey the sheets S in a state where the predetermined loop amount or more is ensured. Accordingly, the sheets S are not pulled between the transfer nip portion and the fixing nip portion, and the toner images transferred to the sheets S at the transfer nip portion are not affected, either.

The printer 100 includes a sheet delivery roller pair 20 as a sheet delivery unit. The sheet delivery roller pair 20 is placed above the fixing device 10 in an upper portion of the printer main body 100A, and delivers, to an outside of the printer main body 100A, the sheets on which the toner images are fixed by the fixing device 10. The sheet delivery roller pair 20 includes a delivery drive roller 15 and a delivery driven roller 16.

The printer 100 includes a sheet delivery tray 17 that is placed in the upper portion of the printer main body 100A so as to be exposed to the outside of the printer main body 100A, and stacks thereon the sheets S delivered from the sheet delivery roller pair 20. The sheet delivery tray 17 includes a sheet stacking surface 17*a* inclined downward from a downstream toward an upstream in the sheet delivery direction, and a wall portion 17*b* extended upward from the upstream of the sheet stacking surface 17*a*. The sheet delivery roller pair 20 is placed above the wall portion 17*b* of the sheet delivery tray 17.

The printer 100 includes a control device 500 for controlling the entire printer, and a media sensor 7 as a sheet detection unit that is placed between the registration roller pair 5*c* and the transfer nip portion, and detects a type of the sheets S. The media sensor 7 includes an LED 7*a*, and a CCD 7*b* placed opposite to the LED 7*a*.

The printer 100 includes a delivery sensor 14, which is placed between the fixing device 10 and an upper delivery guide 13 for guiding the sheets to the sheet delivery roller pair 20, and detects the sheets S to which the toner images are fixed. The printer 100 includes an environmental sensor 27 as an environmental detection unit, which is installed in an inside of the printer main body 100A, and is placed in the vicinity of the cassette 5*d*. The environmental sensor 27 is a temperature sensor.

The image forming operations of the printer 100 is described below. First, the color of yellow (Y) among the four colors is described as an example. The surface of the photosensitive drum 1Y that rotates clockwise is evenly charged by the primary charger 2Y. Based on a digital image signal transmitted from a personal computer (not shown), the control device 500 outputs a pulse signal to a semiconductor laser of the scanner unit 3. The semiconductor laser of the scanner unit 3 outputs a laser beam 3Y corresponding to the pulse signal input thereto by the control device 500. Then, the laser beam 3Y scans the surface of the charged photosensitive drum 1Y. An electrostatic latent image is formed on the surface of the photosensitive drum 1Y by the scanning with the laser beam 3Y. The latent image formed on the surface of the photosensitive drum 1Y is toner-developed by the developing device 4Y, and is formed into a visible image.

In a similar way, the photosensitive drums 1M, 1C, and 1Bk of the other three colors (magenta (M), cyan (C), and black (Bk)) are also scanned by laser beams 3M, 3C, and 3Bk, respectively, and the electrostatic latent images are also formed on the surfaces of the photosensitive drums 1M, 1C, and 1Bk. The latent images formed on the surfaces of the photosensitive drums 1M, 1C, and 1Bk are toner-developed, and are formed into visible images. The toner images formed into the visible images on the photosensitive drums 1Y, 1M, 1C, and 1Bk are primarily transferred sequentially onto the intermediate transfer belt 9*a* by the primary transfer rollers 9Y, 9M, 9C, and 9Bk opposite to the photosensitive drums 1Y, 1M, 1C, and 1Bk through the intermediate transfer belt 9*a*.

In parallel with the toner image forming operations, in the sheet feeding unit 300, the pickup roller 5*a* is driven based on a feeding start signal, and the sheets S in the cassette 5*d* are separated one by one by the feed/retard roller pair 5*b*, and are sent out thereby. The sent-out sheets S are conveyed by the feed/retard roller pair 5*b*, and are guided to the registration roller pair 5*c*. Skew feed of the sheets S conveyed to the registration roller pair 5*c* is corrected therein.

Thereafter, the sheets S are conveyed by the registration roller pair 5*c* while taking timing so that the leading edges of the sheets S may coincide with leading edges of the toner images formed on the surface of the intermediate transfer belt 9*a*. At this time, the type of the sheets S passing by the media sensor 7 is detected. To be more specific, when the sheets S pass by the media sensor 7, the control device 500 allows the LED 7*a* to emit light, detects a light amount transmitted through each of the sheets S by the CCD 7*b*, and determines a thickness (that is, type) of the sheet in response to the detected transmitted light amount.

The detected light amount is output as a voltage by the CCD 7*b*, and the control device 500 determines that the sheet is <thick paper> if the detected voltage V is equal to or greater than a first voltage value V1 but less than a second voltage value V2 higher than the first voltage value V1. The control device 500 determines that the sheet is <plain paper> if the detected voltage V is equal to or greater than the second voltage value V2 but less than a third voltage value V3 higher than the second voltage value V2. The control device 500 determines that the sheet is <thin paper> if the detected voltage V is equal to or greater than the third voltage value V3 but less than a fourth voltage value V4 higher than the third voltage value V3.

The toner images on the intermediate transfer belt 9*a* are secondarily transferred to the conveyed sheet S by the secondary transfer roller 8. The sheet S to which the toner image is transferred is guided to the fixing device 10. Subsequently, the sheet S is heated/pressurized by the heating roller 19 and pressure roller 18 of the fixing device 10, whereby the toner images are fixed, and the sheet S is nipped and conveyed by the heating roller 19 and the pressure roller 18. At this time, the control device 500 adjusts a temperature of the heater of the heating roller 19 of the fixing device 10 in response to the type of the sheet S, which is detected by the media sensor 7, and to an ambient temperature detected by the environmental sensor 27.

After the delivery sensor 14 is actuated, the sheet S to which the toner images are fixed is delivered to the outside of the printer main body 100A by the sheet delivery roller pair 20. At this time, the sheet S is delivered in a state where a surface thereof on which the toner images are formed faces downward (face down). The delivered sheet is stacked on the sheet delivery tray placed outside of the printer main body 100A.

Each of the sheets S which have passed through the fixing device 10 is delivered in a heat-accumulated state due to the heating by the heating roller 19. In particular, the trailing edge portions of the delivered sheets, which are close to the pair of sheet delivery rollers, are stacked on the previously stacked sheets in a state where a time in which the trailing edge portion is cooled by contact with the air during delivery is shorter than a cooling time of a leading edge portion of each of the sheets. Hence, the trailing edge portions of the sheets are more likely to adhere to each other than the leading edge portions. The printer 100 of the first embodiment includes a supporting unit 28 as a supporting unit that is placed between the sheet delivery roller pair 20 and the sheet stacking surface 17*a* of the sheet delivery tray 17, and includes a supporting member 25 for temporarily supporting the trailing edge portion of the sheet S delivered from the sheet delivery roller pair 20. The supporting member 25 temporarily supports the trailing edge portion of the sheet S delivered from the sheet delivery roller pair 20 before the trailing edge portion of the sheet S falls on the sheet stacking surface 17*a* of the sheet delivery tray 17. The printer 100 includes a blower unit 29 for blowing air from the trailing edge portion of the sheet S supported by the supporting member 25 to the leading edge portion thereof along a plane (lower surface in this embodiment) of the sheet S in a state where the sheet S is supported by the supporting member 25.

Figure 2A:
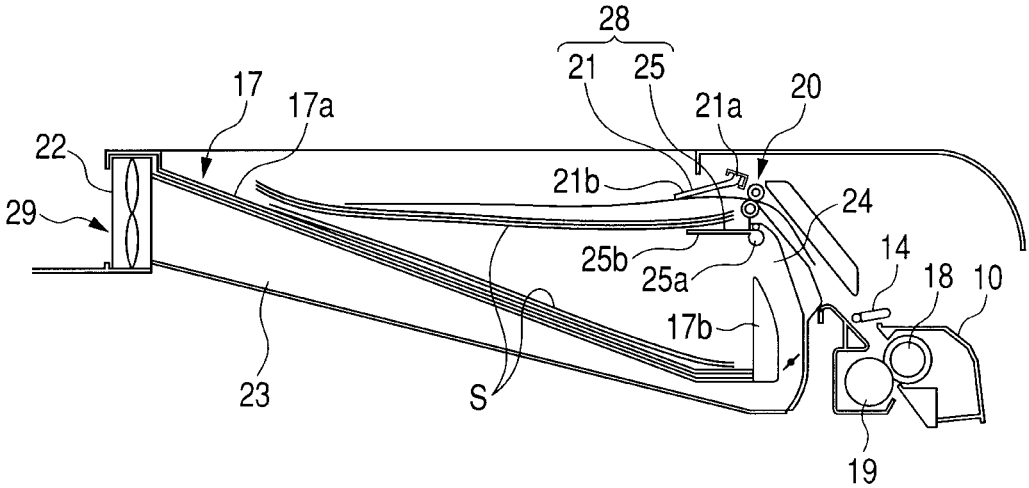
Figure 2B:
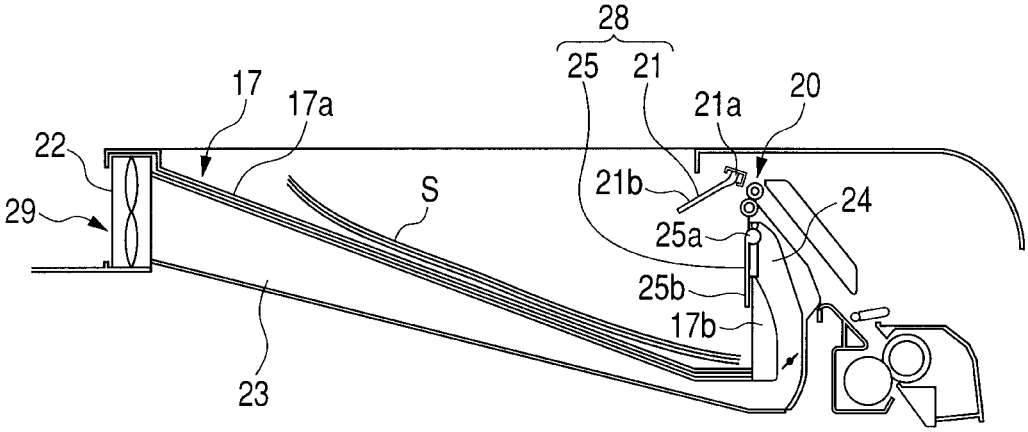

FIGS. 2A and 2B are explanatory views of principal portions of the printer 100, illustrating operations of delivering the sheets S. Specific configurations are described below while referring to FIGS. 2A and 2B. The blower unit 29 includes a blower fan 22 placed in a downstream portion of the sheet delivery tray 17 in the sheet delivery direction in the upper portion of the printer main body 100A. The blower fan 22 is an air intake fan for taking in air from a side surface of the printer main body 100A. The blower unit 29 further includes a fan duct 23 for guiding the air, which is taken in by the blower fan 22, to a blower port 24 formed at an upper end of the wall portion 17*b* of the sheet delivery tray 17 between the sheet stacking surface 17*a* and the sheet delivery roller pair 20. Accordingly, when the blower fan 22 is operated, the air blows out of the blower port 24 substantially horizontally from upstream toward downstream in the sheet delivery direction. Hence, the blower unit 29 may blow the air along the lower surface of the sheet S, which is supported by the supporting member 25, from the upstream edge portion (trailing edge portion) of the sheet S in the sheet delivery direction toward the downstream edge portion (leading edge portion) thereof in the sheet delivery direction.

The supporting member 25 includes a pivot portion 25*a* placed between the sheet delivery roller pair 20 and the blower port 24, and an extended portion 25*b* extended from the pivot portion 25*a*. The supporting member 25 is supported on the printer main body 100A so as to be swingable about the pivot portion 25*a*. The supporting unit 28 includes a pressing member 21 including a pivot portion 21*a* placed above the sheet delivery roller pair 20, and an extended portion 21*b* extended from the pivot portion 21*a*. The pressing member 21 presses the sheet supported by the supporting member 25.

The supporting member 25 is supported so as to be movable between a first position for supporting the trailing edge portion of the sheet S delivered by the sheet delivery roller pair 20 and a second position for releasing the trailing edge portion of the sheet S and causing the sheet S to fall. The first position is a position at which the extended portion 25*b* becomes substantially horizontal, and the second position is a position at which the extended portion 25*b* becomes substantially vertical. The supporting member 25 is made of a resin.

Figure 3A:
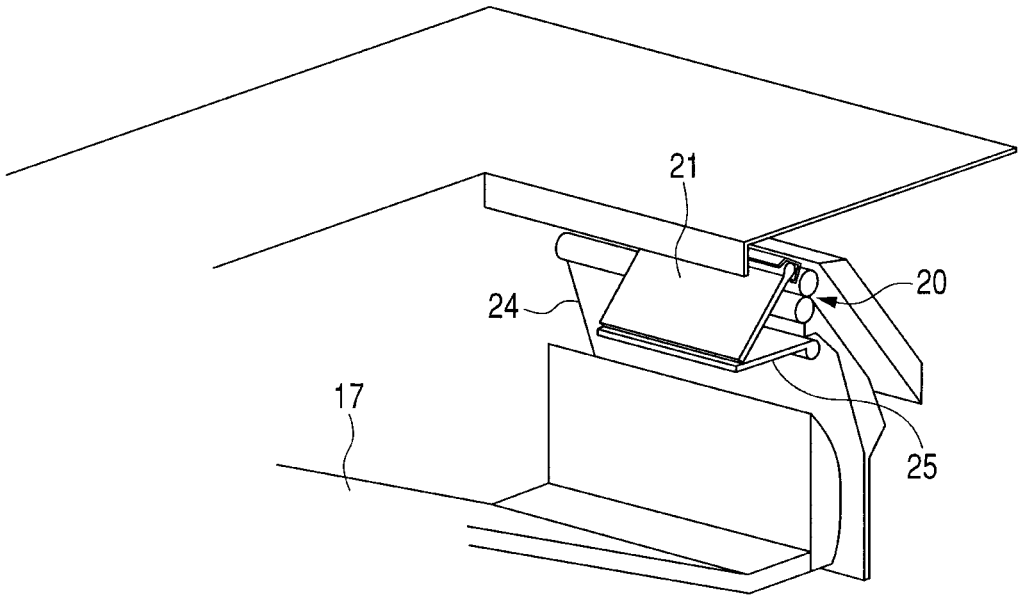
Figure 3B:
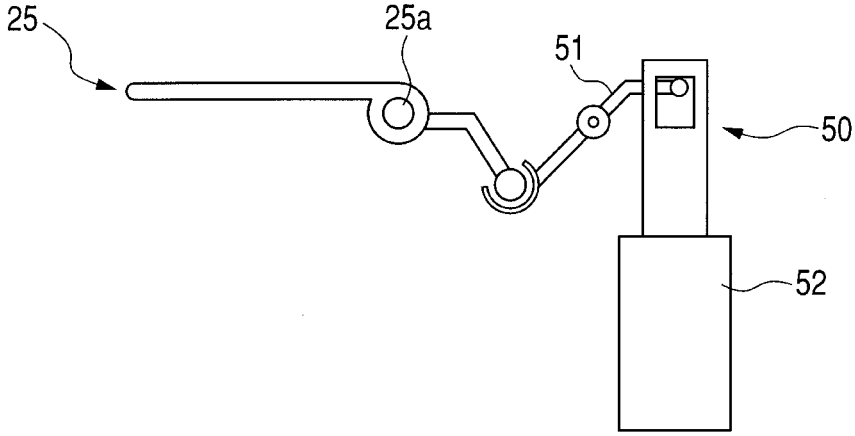
Figure 4A:
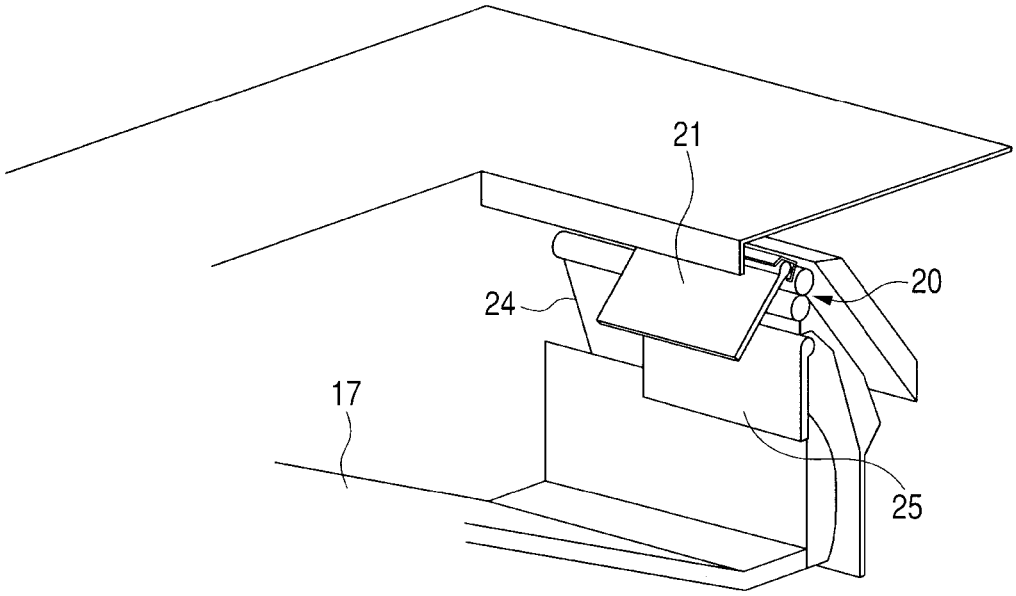
Figure 4B:
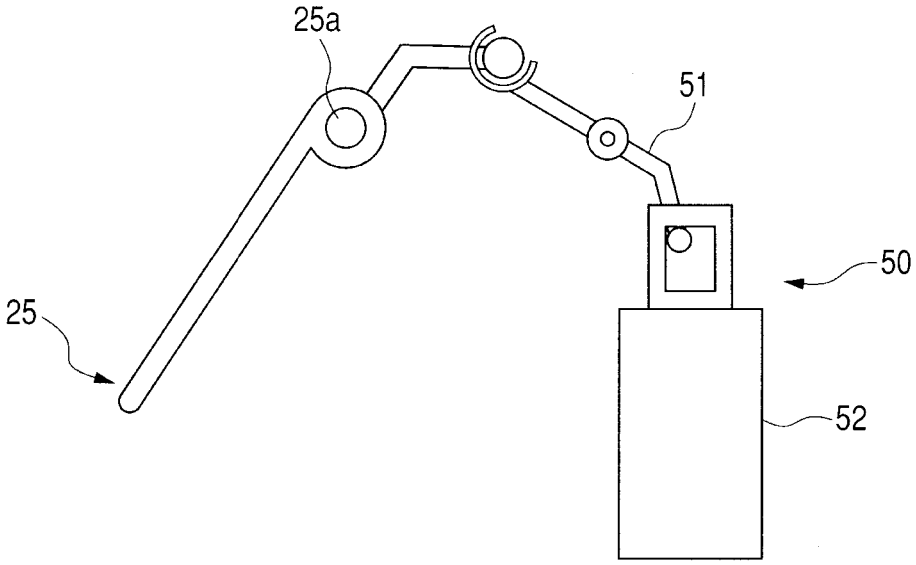

FIGS. 3A and 3B are explanatory views of a state where the supporting member 25 is moved to the first position, and FIGS. 4A and 4B are explanatory views of a state where the supporting member 25 is moved to the second position. The printer 100 includes a moving mechanism 50 as a moving unit for moving the supporting member 25 to the first position (FIG. 3B) and the second position (FIG. 4B). The moving mechanism 50 includes a lever 51 that is coupled to the supporting member 25 and is rotatably supported on the printer main body, a solenoid 52 for rotationally operating the lever 51, and a spring (not shown) that urges the supporting member 25 to the first position illustrated in FIG. 3A. The supporting member 25 is urged to the first position by the spring (not shown), and is thereby supported at the first position illustrated in FIG. 3A. When the solenoid 52 is energized, the solenoid 52 rotationally operates the lever 51. The supporting member 25 is operated by the energized solenoid 52 through the lever 51, and rotates about the pivot portion 25*a* to the second position illustrated in FIG. 4A against urging force of the spring (not shown). When the energization to the solenoid 52 is stopped, the supporting member 25 returns to the first position illustrated in FIG. 3A by the urging force of the spring (not shown).

The moving mechanism 50 for moving the supporting member 25 is controlled by the control device 500 (FIG. 1) that functions as a supporting control unit. The control device 500 executes the energization/non-energization to the solenoid 52 of the moving mechanism 50, and operates the supporting member 25 through the lever 51, thereby controlling the position of the supporting member 25.

The pressing member 21 is urged against the supporting member 25, which has moved to the first position, so as to press the sheet against the supporting member 25. In the first embodiment, the pressing member 21 is urged against the supporting member 25 by a self weight thereof, but may be urged by a spring (not shown). In a state where the sheet S is not present, the pressing member 21 abuts on the supporting member 25 that has moved to the first position, and in a state where the sheet S is present, the pressing member 21 nips the trailing edge portion of the sheet S together with the supporting member 25 that has moved to the first position. The supporting member 25 and the pressing member 21 are placed at substantially a center in a width direction perpendicular to the sheet delivery direction, and support substantially a center portion of the trailing edge portion of the sheet S in a width direction.

As illustrated in FIGS. 2A and 2B, with the above-mentioned configuration, the sheet S delivered by the sheet delivery roller pair 20 is delivered while pushing up the pressing member 21 by pressing force (stiffness) of the sheet. The leading edge portion of the sheet S is delivered along the sheet delivery tray 17. At the point of time when the trailing edge portion of the sheet exits from the sheet delivery roller pair 20, the trailing edge portion of the sheet is pressed down against the supporting member 25 by the self weight of the pressing member 21. In other words, the trailing edge portion of the sheet, delivered from the sheet delivery roller pair 20, is stopped on the supporting member 25 without fail by a breaking force applied from the pressing member 21, and is supported by the supporting member 25 that has moved to the first position and the pressing member 21 placed opposite to the supporting member 25, and is thereby supported temporarily therebetween.

When the supporting member 25 moves to the second position, such nipping force by the pressing member 21, which is applied from an upper surface of the supported sheet, loses an effect thereof, the trailing edge portion of the sheet is released, and the sheet falls and stacked onto the sheet delivery tray 17 located therebelow. A series of operations, which are the supporting and releasing of the trailing edge portion of the sheet at the supporting unit 28, may be realized by a simple configuration in which the operations of the pressing member 21 merely follow the operations of the supporting member 25.

The trailing edge portion of the sheet S delivered by the sheet delivery roller pair 20 is supported by the supporting member 25 in a state of being supported at the supporting unit 28. The blower fan 22 is made to operate while the sheet S is being delivered by the sheet delivery roller pair 20, and while the sheet S is being supported by the supporting unit 28. Owing to the operation of the blower fan 22, the air is blown out in the substantially horizontal direction from the blower port 24, and the air blown out of the blower port 24 flows along the lower surface of the sheet S supported by the supporting unit 28.

The lower surface of the sheet S supported by the supporting unit 28 is effectively cooled by the air flowing along the lower surface. In particular, the trailing edge portion of the sheet S is exposed to the air blown by the blower unit 29 for a period in which the trailing edge portion of the sheet S is supported by the supporting unit 28, and accordingly, the trailing edge portion is effectively cooled. The upper surface of the sheet S is cooled by being exposed to the external air. In other words, the sheet S supported by the supporting unit 28 is effectively cooled because both surfaces thereof are brought into contact with the air. In the case where another sheet S is already stacked on the sheet delivery tray 17, the blower unit 29 blows the air to a space between the lower surface of the sheet S supported by the supporting unit 28 and an upper surface of the sheet S stacked on the sheet delivery tray 17. Hence, the upper surface of the sheet S already stacked on the sheet delivery tray 17 may be cooled by blowing the air thereto.

Subsequently, when the supporting member 25 is moved to the second position to release the sheet S, the sheet S supported by the supporting member 25 falls down onto the sheet delivery tray 17 or onto the sheet already stacked on the sheet delivery tray 17. At this time, the sheet S thus supported is sufficiently cooled, and accordingly, the sheets may be effectively suppressed from adhering to each other, and decrease of quality of the image formed on the sheet S may be suppressed.

The blower unit 29 blows the air along the surface of the sheet S on which the image is formed. Accordingly, the mutual adhesion of the sheets and the decrease of the image quality may be suppressed more effectively. When the sheet S is cooled by the air blown by the blower unit 29, the trailing edge portion of the sheet S is supported by the supporting unit 28. Accordingly, a posture of the supported sheet S may be prevented from being displaced by the air blown to the lower surface thereof. Hence, even in the case where the sheet is caused to fall and stacked on the sheet delivery tray 17, the sheet may be prevented from being displaced. The blower unit 29 blows the air along the lower surface of the sheet S, and accordingly, there is a low possibility that the sheet S may fall down even if the trailing edge portion of the sheet S is only supported by the supporting member 25. However, the trailing edge portion of the sheet S is nipped by the pressing member 21, with the result that the sheet S may be supported in a more stable posture.

The sheets S delivered from the sheet delivery roller pair 20 may be cooled one by one. However, in the case where an image forming speed in the image forming unit 200 is increased, a sheet delivery speed of the sheet delivery roller pair 20 is also increased. Hence, in some cases, it is more efficient to collectively cool multiple sheets S than to cool the sheets S one by one.

It is described below in detail while referring to FIGS. 2A and 2B. In FIG. 2A, the sheets S which have passed through the fixing device 10 are sequentially delivered to the supporting unit 28. As described above, the lower surface of the first sheet S that is delivered first and becomes a lowermost layer is cooled by the air blown by the blower unit 29, the upper surface of the first sheet S is cooled by the external air, and the first sheet S is sufficiently cooled. The second sheet S that comes next is delivered by the sheet delivery roller pair 20 along the upper surface of the cooled first sheet while pushing up the pressing member 21. At the point of time when a trailing edge portion of the second sheet exits from the sheet delivery roller pair 20, the trailing edge portion of the second sheet is stopped on the supporting member 25, and the pressing member 21 presses the two sheets S supported by the supporting member 25.

The air blown out by the blower unit 29 does not directly contact a lower surface of the sheet S delivered onto the lowermost sheet S, or slightly contacts the lower surface. However, the lowermost sheet S is in a cooled state, and receives the air blown by the blower unit 29, and accordingly, the heat of the sheet S delivered onto the lowermost sheet S is removed by the lowermost sheet S, and is effectively emitted by the air blown by the blower unit 29. The upper surface of the second sheet S is exposed to the external air, and accordingly, is cooled thereby. The third and subsequent sheets S which are to be delivered are also cooled in a similar way to the second sheet S.

In the case where the sheets are already stacked on the sheet delivery tray 17, the blower unit 29 blows the air to a space between an upper surface of the uppermost sheet S among the stacked sheets and the lower surface of the sheet S supported by the supporting unit 28. The upper surface of the uppermost sheet S among the sheets stacked on the sheet delivery tray 17 is cooled by the blower unit 29, and accordingly, residual heat in the stacked sheets may be effectively removed, and the mutual adhesion of the sheets may be effectively suppressed.

After multiple sheets S supported by the supporting member 25 are cooled, the supporting member 25 is moved to the second position as illustrated in FIG. 2B, the multiple sheets S are caused to fall down on the sheet delivery tray 17 or on the sheets already stacked on the sheet delivery tray 17. Accordingly, the mutual adhesion of the sheets may be effectively suppressed because the sheets are cooled sufficiently.

Next, in the first embodiment, the sheet delivery roller pair 20 delivers the sheets S and the supporting member 25 sequentially support the delivered sheets S, and then control is made so that the supporting member 25 may release the sheets S when the number of the supported sheets S reaches a preset number. In other words, in the case where the number of sheets supported by the supporting member 25 reaches the preset predetermined number, the control device 500 controls the moving mechanism 50 to release the sheets supported by the supporting member 25. Further, an air flow rate of the blower unit 29 also differs depending on a variety of conditions, and accordingly, in the first embodiment, the air flow rate of the blower unit 29 is controlled depending on the conditions.

The blower unit 29 (that is, blower fan 22) is controlled by the control device 500 as a controller. The control device 500 also functions as an air flow rate control unit for controlling the air flow rate of the blower unit 29 as well as the supporting control unit described above.

To be more specific, the control device 500 sets a maximum number of sheets S to be supported by the supporting member 25 at a predetermined number based on sheet information. Hereinafter, the maximum number is referred to as the number of sheets to be supported. The sheet information is information regarding the types of sheets, and heat radiation properties differ depending on the types of sheets. For example, thin papers which are thinner than plain papers are more likely to radiate heat than the plain papers, and thick papers which are thicker than the plain papers, are less likely to radiate heat than the sheets of the plain paper. In the case of forming an image on smooth sheets of paper, rough sheets of paper, diverse films, or sheets coated with a special coating material, fusibility of the toner in the toner image that has passed through the fixing device differs depending on the types of sheets. Therefore, the measures against the mutual adhesion of the sheets are necessary according to the types of sheets.

A user presets the information regarding the type of the sheets by selection thereof by using an operation unit (not shown). For example, the types of sheets S are classified in terms of basis weight as follows: sheets with a basis weight of 60 g/m$^2$ or less are <thin paper>; sheets with a basis weight ranging from 60 to 105 g/m$^2$ (exclusive) are <plain paper>; and sheets with a basis weight of 105 g/m$^2$ or more are <thick paper>. In this case, the user presets the type of the sheets from among the classified types by the selection thereof.

Based on the set type of the sheets, the control device 500 selectively sets the number of sheets to be supported. In the case where <thick paper> is selected, the number of sheets to be supported is set at N1 sheets. In the case where <plain paper> is selected, the number of sheets to be supported is set at N2 sheets. Further, in the case where <thin paper> is selected, the number of sheets to be supported is set at N3 sheets. As the sheets become thinner, the sheets are more easily cooled. Accordingly, the number of sheets to be supported is set so as to establish a relationship of N1<N2<N3. In other words, the number of sheets to be supported is set so as to be increased as the sheets become thinner. For example, if the sheets are <thin paper> which is more likely to radiate heat and to be cooled, then N3 is set at 6 to 8 sheets. If the sheets are <plain paper>, then N2 is set at 4 to 5 sheets. If the sheets are <thick paper> which is less likely to radiate heat and to be cooled, then N1 is set at 1 to 3 sheets.

Next, the control device 500 sets the flow rate of the air from the blower port 24 of the blower unit 29, that is, the number of revolutions of the blower fan 22 based on the sheet information (information regarding the sheet type). In the case where <thick paper> is selected, then the air flow rate is set at F1 m/sec. In the case where <plain paper> is selected, then the air flow rate is set at F2 m/sec. In the case where <thin paper> is selected, then the air flow rate is set at F3 m/sec.

As the sheets become thinner, the sheets are more easily cooled. Accordingly, the air flow rate is set so as to establish a relationship of F1>F2>F3. In other words, the air flow rate is set so as to be decreased as the sheets become thinner. Meanwhile, the air flow rate is set so as to be increased as the sheets become thicker.

In the first embodiment, a heat radiation effect of the sheets is reduced as the sheets become thicker, and hence the number of sheets to be supported is set smaller, and the air flow rate is set larger, to thereby enhance a cooling effect. In the first embodiment, the heat radiation effect of the sheets is increased as the sheets become thinner, and hence the number of sheets to be supported is set larger, and the air flow rate is set smaller. Even if the number of sheets S to be supported by the supporting member 25 is set larger, the sheets S may be supported by the supporting member 25 without any problem and the air flow rate may be set smaller if the sheets S are the thin paper. Accordingly, the fluctuation in posture of the sheets S in the supporting member 25 may be reduced. The number of sheets to be supported and the air flow rate are set based on the sheet types, and accordingly, the cooling effects optimal for the respective sheet types may be obtained. The supporting member 25 is moved to the second position by the moving mechanism 50 operated by the control of the control device 500, to thereby cause the cooled sheets S to fall down on the sheet delivery tray 17, and accordingly, the sheets S may be effectively suppressed from adhering to each other.

The number of sheets S to be delivered is always counted by the delivery sensor 14. It is also possible to provide a sensor (not shown) for detecting the action of the pressing member 21, and to detect the number of sheets S to be delivered based on the number of actions. Further, it is also possible to detect the number of sheets to be delivered based on the number of images expanded, for printing, on an image controller (not shown). As described above, a detection unit for the number of sheets to be delivered is realizable by a variety of configurations.

It is also possible to include <smooth paper>, <rough paper> with a rough surface, and the like as the sheet types in options of the sheet types besides the above-mentioned three types, which are <thin paper>, <plain paper>, and <thick paper>. Accordingly, the options of the sheet types are increased, and therefore, the further cooling effects optimal for the respective sheet types are obtained, and it becomes further possible to reduce the mutual adhesion of the sheets.

Second Embodiment

Figure 5:
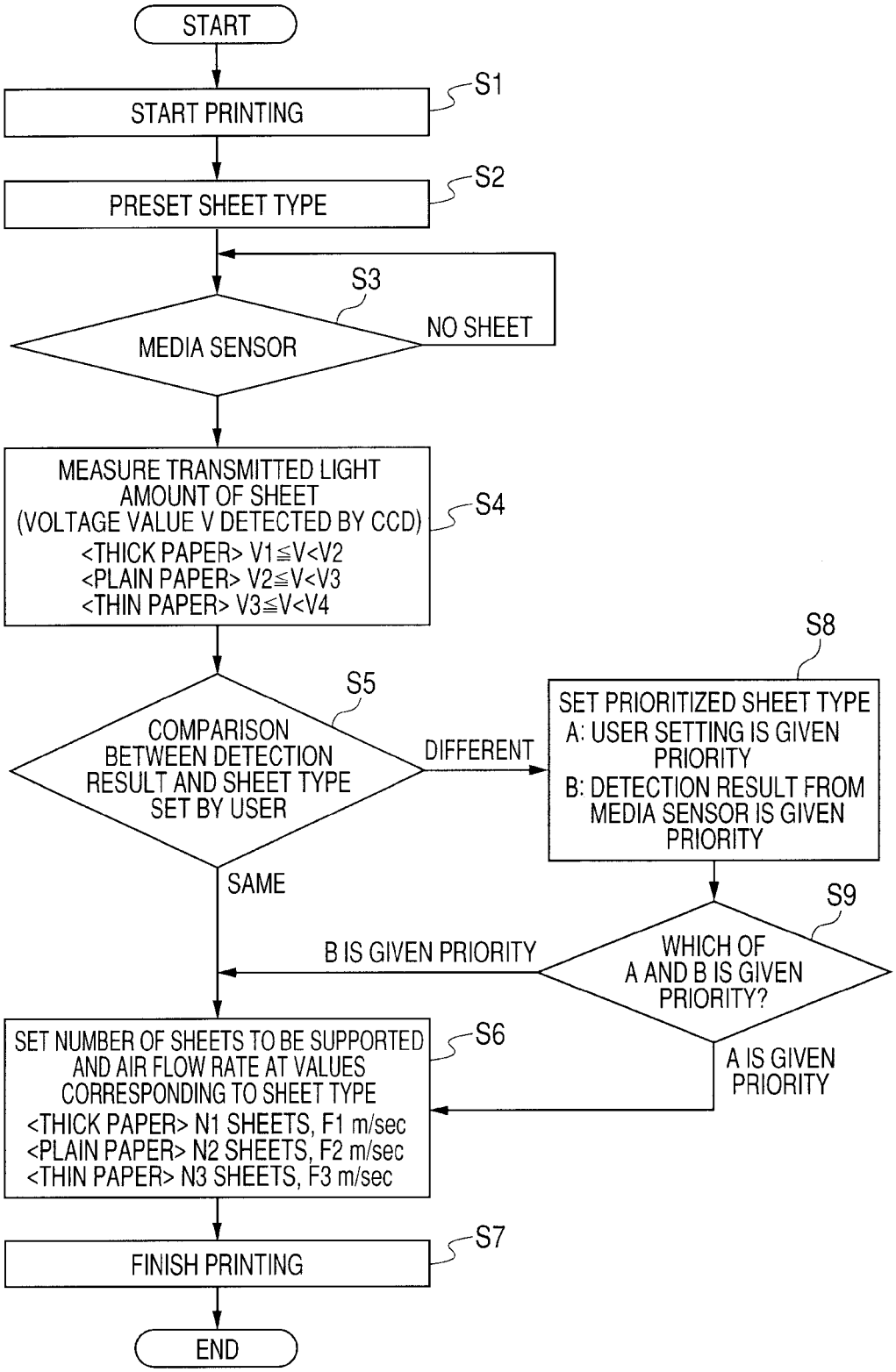
FIG. 5 is a flowchart of control operations for setting the number of sheets to be supported by the supporting member and an air flow rate of a blower unit according to a second embodiment of the present invention.

In the above-mentioned first embodiment, the description has been made of the case of setting the number of sheets to be supported by the supporting member 25 and the air flow rate of the blower unit 29 based on the sheet information set by the selection of the user. In the second embodiment, a description is made of a case of setting the number of sheets to be supported by the supporting member 25 and the air flow rate of the blower unit 29 based on the sheet information set by the selection of the user or on sheet information detected by the media sensor 7. In the description of the second embodiment, the same reference symbols and numerals are assigned to configurations similar to those of the first embodiment, and descriptions thereof are omitted. FIG. 5 is a flowchart of control operations for setting the number of sheets to be supported by the supporting member 25 and the air flow rate of the blower unit 29 according to the second embodiment of the present invention. Upon receiving a command to start the printing from the operation unit (not shown) (S1), the control device 500 presets the information regarding the sheet type (S2). The information regarding the sheet type is selected by the user using the operation unit (not shown).

Next, the control device 500 determines whether or not the sheet is detected by the media sensor 7 serving as a sheet type detection unit (S3). If it is determined that no sheet is present, the control device 500 continues to execute the determination processing of S3 until the sheet is detected. If the sheet is detected by the media sensor 7, the control device 500 allows the LED 7*a* to emit light, detects the amount of transmitted light passing through the sheet S by the CCD 7*b*, and determines the sheet thickness (sheet type) based on a transmitted light amount thus detected (S4).

To be more specific, the control device 500 determines that the sheet is <thick paper> if the voltage V of the CCD 7*b* is equal to or greater than the first voltage value V1 but less than the second voltage value V2 higher than the first voltage value V1. The control device 500 determines that the sheet is <plain paper> if the detected voltage V is equal to or greater than the second voltage value V2 but less than the third voltage value V3 higher than the second voltage value V2. The control device 500 determines that the sheet is <thin paper> if the detected voltage V is equal to or greater than the third voltage value V3 but less than the fourth voltage value V4 higher than the third voltage value V3.

Next, the control device 500 compares a result of the determination processing of S4 with the information regarding the sheet type preset by the user in S2 (S5). In the case where the determination result is the same as the information, the control device 500 sets the number of sheets to be supported and the air flow rate, which correspond to that sheet type (S6). To be more specific, in the case of <thick paper>, the number of sheets to be supported is set at N1 sheets, and the air flow rate is set at F1 m/sec. In the case of <plain paper>, the number of sheets to be supported is set at N2 sheets, and the air flow rate is set at F2 m/sec. Further, in the case of <thin paper>, the number of sheets to be supported is set at N3 sheets, and the air flow rate is set at F3 m/sec. In a similar way to the above-mentioned first embodiment, the number of sheets to be supported is set so as to establish a relationship of N1<N2<N3, and the air flow rate is set so as to establish a relationship of F1>F2>F3. Thereafter, the control device 500 finishes the printing (S7). In such a way, in a similar way to the above-mentioned first embodiment, the number of sheets to be supported and the air flow rate are set based on the sheet type, and accordingly, the cooling effects optimal for the respective sheet types are obtained.

Next, in the case where the result of the determination processing of S4 and the information regarding the sheet type preset by the user in S2 are different from each other as a result of the comparison in the determination processing in S5, the control device 500 makes setting as to which is given priority (S8). To be more specific, the control device 500 makes setting as to which of a case A and a case B is given priority, in which A is the case where the setting by the user in S2 is given priority, and B is the case where the detection result by the media sensor 7 is given priority. This setting is made based on a result preselected by the user using the operation unit (not shown). The control device 500 determines which of A and B is given priority (S9). When A is given priority, the control device 500 gives priority to the setting by the user of S2. When B is given priority, the control device 500 gives priority to the detection result by the media sensor 7. Then, the control device 500 executes the above-mentioned processing of S6. In other words, the number of sheets to be supported and the air flow rate, which correspond to the sheet type set preferentially, are set.

The number of sheets S to be supported by the supporting member 25 and the air flow rate of the blower unit 29 are controlled based on the detection result of the media sensor 7. Therefore, the more efficient and optimal cooling effects are obtained, and it becomes possible to reduce the mutual adhesion of the sheets when the sheets are stacked.

The media sensor 7 described herein is merely an example, and besides this, a surface property detection sensor for detecting surface properties of the sheets S may be used. Further, the media sensor 7 and the surface property detection sensor may be combined with each other, and such combination enables more detailed definitions of the number of sheets S to be supported by the supporting member 25 and the flow rate of the air from the blower port 24.

Third Embodiment

Figure 6:
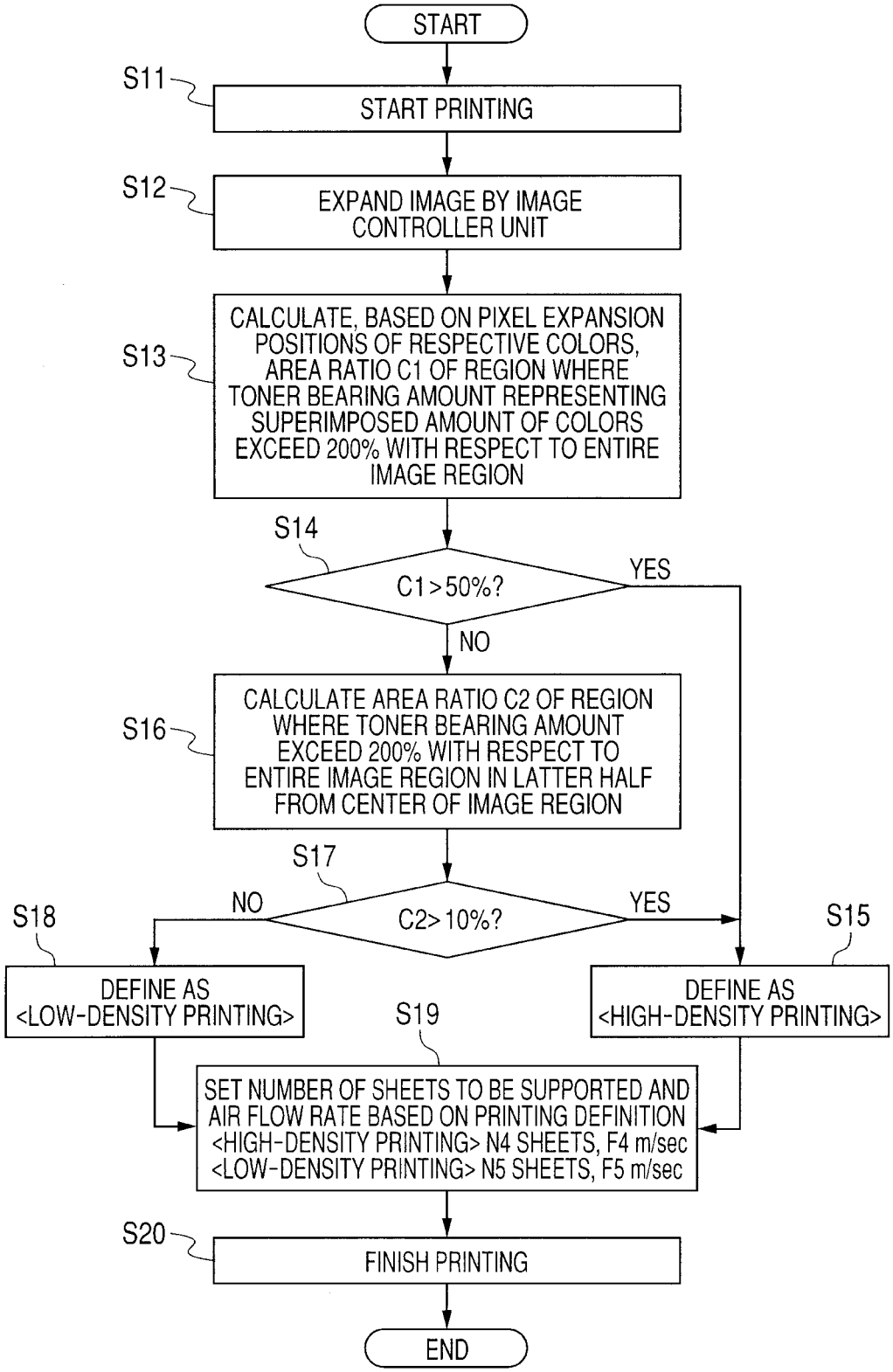
FIG. 6 is a flowchart of control operations for setting the number of sheets to be supported by the supporting member and the air flow rate of the blower unit according to a third embodiment of the present invention.

In the above-mentioned first and second embodiments, the description has been made of the case of setting the number of sheets to be supported by the supporting member 25 and the air flow rate of the blower unit 29 based on the sheet information. In the third embodiment, a description is made of a case of setting the number of sheets to be supported by the supporting member 25 and the air flow rate of the blower unit 29 based on information on the images formed on the sheets. In the description of the third embodiment, the same reference symbols and numerals are assigned to configurations similar to those of the first embodiment, and descriptions thereof are omitted. FIG. 6 is a flowchart of control operations for setting the number of sheets to be supported by the supporting member 25 and the air flow rate of the blower unit 29 according to the third embodiment of the present invention. Upon receiving the command to start the printing from the operation unit (not shown) (S11), the control device 500 allows the image controller unit (not shown) to expand an image to be formed (S12). In other words, when the image to be formed is expanded by the image controller unit (not shown), the control device 500 calculates relative positional relationships among the pixels expanded in images of the respective colors of yellow (Y), magenta (M), cyan (C), and black (Bk).

Next, at the time of forming the electrostatic latent images on the photosensitive drums 1Y, 1M, 1C, and 1Bk illustrated in FIG. 1 by the laser beams 3Y, 3M, 3C, and 3Bk, the control device 500 calculates a toner bearing amount representing a superimposed amount of each color formed as the toner image for each pixel. The control device 500 calculates an area ratio C1 of a region where the toner bearing amount exceeds a predetermined value (for example, 200%) with respect to the entire image region (S13). With regard to the toner bearing amount, the toner bearing amount of a solid image of the primary color is defined as 100%, and the toner bearing amount of a solid white image is defined as 0%. To give an example, a solid image of red as a secondary color is formed by superimposing solid images of magenta and yellow, which are the primary colors, on each other, and accordingly, the toner bearing amount of the solid image of red is defined as 200%.

Next, the control device 500 determines whether the area ratio C1 exceeds 50% (S14). In the case where the area ratio C1 exceeds 50% (S14: Yes), the control device 500 defines the printing as <high-density printing (S15). When the area ratio C1 exceeds 50%, the sheets are more likely to adhere to each other by the toner fused by heat, and accordingly, the printing is defined as <high-density printing>.

In the case where the area ratio C1 is 50% or less (S14: No), the control device 500 calculates an area ratio C2 of a region where the toner bearing amount exceeds 200% with respect to the entire image region in a latter half from the center of the image region in the sheet delivery direction (S16). Next, the control device 500 determines whether or not the area ratio C2 exceeds 10% (S17). In the case where the area ratio C2 exceeds 10% (S17: Yes), the control device 500 defines the printing as <high-density printing> (S15), and in the case where the area ratio C2 is 10% or less (S17: No), the control device 500 defines the printing as <low-density printing> (S18). The latter half from the center of the image region in the sheet delivery direction is in contact with the external air for a shorter time than a former half from the center of the image region in the sheet delivery direction. Accordingly, in the latter half, even if the area ratio C1 is 50% or less, the sheets are more likely to adhere to each other when the area ratio C2 exceeds 10%. Therefore, the printing is defined as <high-density printing>. For example, printing of a document image only having letters and printing of an image in which the toner bearing amount is small are defined as <low-density printing>, and printing of an image in which the toner bearing amount is large, such as full photographic image and graph, is defined as <high-density printing>.

Thereafter, the control device 500 sets the number of sheets S to be supported by the supporting member 25 and the air flow rate in the blower unit 29 based on the image information (that is, information of <high-density printing> and <low-density printing>) (S19). To be more specific, in the case of defining the printing as <high-density printing>, the control device 500 sets the number of sheets S to be supported by the supporting member 25 at N4 sheets, and sets the air flow rate of the blower unit 29 at F4 m/sec. Further, in the case of defining the printing as <low-density printing>, the control device 500 sets the number of sheets to be supported at N5 sheets, and sets the air flow rate at F5 m/sec. Then, the control device 500 makes setting such that the number of sheets to be supported establishes a relationship of N4<N5, and so that the air flow rate establishes a relationship of F4>F5. In the case where the printing is defined as <high-density printing>, the sheets are more likely to adhere to each other, and accordingly, the number of sheets to be supported is set smaller than in the case of <low-density printing> (N4<N5), and the air flow rate is set larger than in the case of <low-density printing> (F4>F5). Thereafter, the control device 500 finishes the printing (S20). Owing to the setting of the number of sheets to be supported and the air flow rate, the sheets obtain the cooling effects optimal for the respective toner bearing amounts, and the adhesion at the time when the sheets are stacked may be effectively reduced.

Fourth Embodiment

Figure 7:
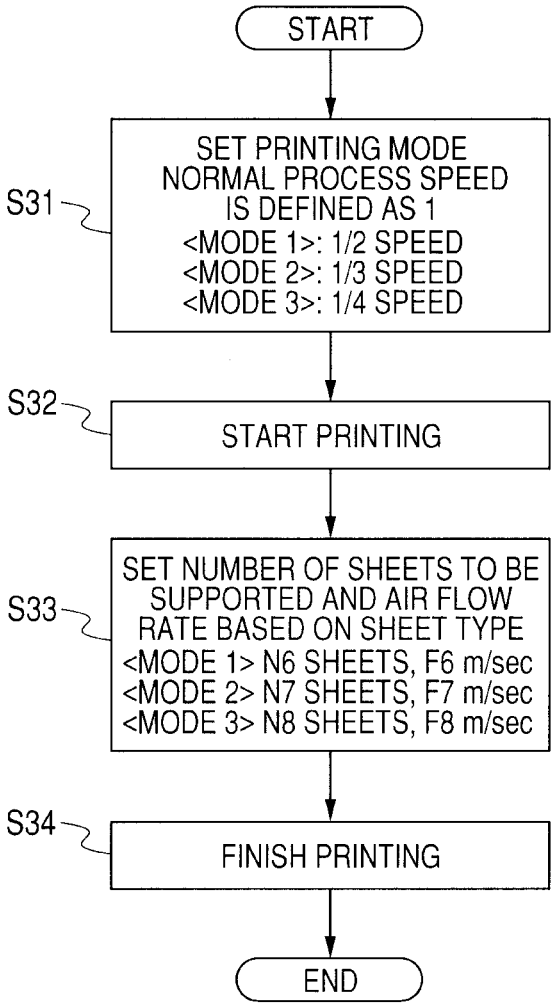
FIG. 7 is a flowchart of control operations for setting the number of sheets to be supported by the supporting member and the air flow rate of the blower unit according to a fourth embodiment of the present invention.

In the fourth embodiment, a description is made of a case of setting the number of sheets to be supported by the supporting member 25 and the air flow rate of the blower unit 29 based on information on sheet delivery speed of the sheet delivery roller pair 20. In the description of the fourth embodiment, the same reference symbols and numerals are assigned to configurations similar to those of the first embodiment, and descriptions thereof are omitted. FIG. 7 is a flowchart illustrating control operations for setting the number of sheets to be supported by the supporting member 25 and the air flow rate of the blower unit 29 according to the fourth embodiment of the present invention.

The conveying speed of the sheets S in the image forming unit 200 and the fixing device 10, which are illustrated in FIG. 1, differs depending on printing modes. For example, there are cases in which an image is formed on a sheet which is not the plain paper. Examples of those cases include a case of printing a high-definition image such as a photographic image on glossy paper, a case of printing on the rough paper with the rough surface, and a case of printing on the thick paper or specialty paper designated arbitrarily as well as the case of printing on the plain paper. In such cases, printing modes may be set so that a process speed (transfer speed, fixing speed) is reduced to a ½ speed, a ⅓ speed, or the like with respect to a normal process speed for the plain paper. The transfer speed refers to a rotation speed of the photosensitive drums 1, and the fixing speed refers to a rotation speed of the heating roller 19. A delivery speed of the sheets delivered from the sheet delivery roller pair 20 is the same as the process speed. When the process speed is reduced, the sheet delivery speed is also reduced.

The control device 500 sets the printing mode (S31). To be more specific, if the sheets S for use are the thick paper, the control device 500 sets the printing mode to <Mode 1>, and sets the process speed at the ½ speed of the normal speed. If the sheets S for use are the rough paper, the control device 500 sets the printing mode to <Mode 2>, and sets the process speed at the ⅓ speed. If the sheets S for use are the specialty paper on which the photographic image is printed, the control device 500 sets the printing mode to <Mode 3>, and sets the process speed at a ¼ speed. Then, the control device 500 starts the printing (S32).

Based on the printing mode, that is, on the sheet delivery speed, the control device 500 sets the number of sheets S to be supported in the supporting member 25 and the air flow rate of the blower unit 29 (S33). Thereafter, the control device 500 finishes the printing (S34). The processing of S33 is specifically described. In the case of setting the printing mode to <Mode 1>, the control device 500 sets the number of sheets S to be supported at N6 sheets, and sets the air flow rate of the blower unit 29 at F6 m/sec. In the case of setting the printing mode to <Mode 2>, the control device 500 sets the number of sheets to be supported at N7 sheets, and sets the air flow rate at F7 m/sec. In the case of setting the printing mode to <Mode 3>, the control device 500 sets the number of sheets to be supported at N8 sheets, and sets the air flow rate at F8 m/sec. The number of sheets to be supported is set so as to establish a relationship of N6>N7>N8, and the air flow rate is set so as to establish a relationship of F6>F7>F8.

As the process speed (sheet delivery speed) is reduced, it takes a longer time from the delivery of one sheet S to the delivery of the next sheet S than the time in the normal process speed. Therefore, the cooling effect by the heat radiation from the sheets S delivered and supported in the supporting member 25 is high. Hence, as the process speed is reduced, the number of sheets to be supported is set smaller, and the air flow rate is set lower.

Based on the process speed information (sheet delivery speed information), the number of sheets S to be supported in the supporting member 25 and the air flow rate of the blower unit 29 are selectively changed, whereby such a cooling effect optimal for the process speed (sheet delivery speed) is obtained. Hence, the mutual adhesion of the sheets on the sheet delivery tray 17 may be reduced, and at the same time, the air flow rate is optimized, whereby drive power of the blower fan 22 may be reduced, and noise in driving the blower fan 22 may also be reduced.

Fifth Embodiment

Figure 8:
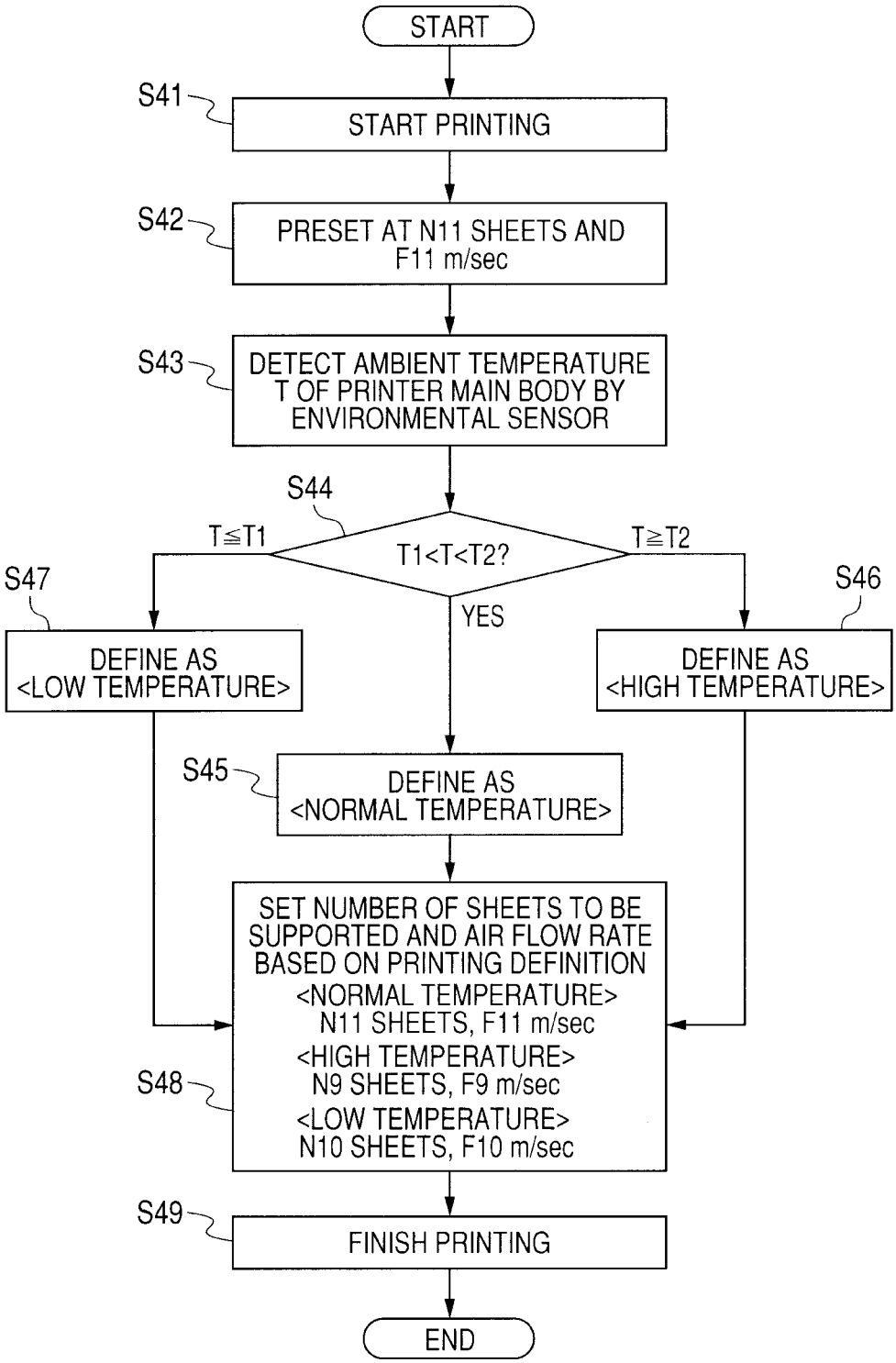
FIG. 8 is a flowchart of control operations for setting the number of sheets to be supported by the supporting member and the air flow rate of the blower unit according to a fifth embodiment of the present invention.

In the fifth embodiment, a description is made of a case of setting the number of sheets to be supported by the supporting member 25 and the air flow rate of the blower unit 29 based on environmental information of the atmosphere in which the printer main body 100A is installed. In the description of the fifth embodiment, the same reference symbols and numerals are assigned to similar configurations to those of the first embodiment described above, and descriptions thereof are omitted. FIG. 8 is a flowchart illustrating control operations for setting the number of sheets to be supported by the supporting member 25 and the air flow rate of the blower unit 29 in the control device 500 of a printer as an example of an image forming apparatus according to the fifth embodiment of the present invention. Upon receiving the command to start the printing from the operation unit (not shown) (S41), the control device 500 presets the number of sheets to be supported in the supporting member 25 at N11 sheets, and sets the air flow rate of the blower unit 29 at F11 m/sec (S42).

Next, the control device 500 receives the environmental information as information regarding the temperature T detected by the environmental sensor 27 (S43). The environmental sensor 27 is placed at a position apart from the fixing device 10 that becomes a heat source and close to the cassette 5*d* in which the sheets S are housed. The environmental sensor 27 detects an ambient temperature T in the printer main body 100A.

Based on the information on the detected temperature T, the control device 500 determines the environment in which the printer main body 100A is installed (S44). To be more specific, the control device 500 determines whether the detected temperature T is greater than a temperature T1 but less than a temperature T2 (T1<T<T2), is equal to or more than the temperature T2, or is equal to or less than the temperature T1. If the detected temperature T is greater than the temperature T1 but less than the temperature T2, then the control device 500 determines that the temperature is <normal temperature> (S45). If the detected temperature T is equal to or more than the temperature T2, then the control device 500 determines that the temperature is <high temperature> (S46). Further, if the detected temperature T is equal to or less than the temperature T1, then the control device 500 determines that the temperature is <low temperature> (S47). Next, based on the information regarding the temperature T, which serves as the environmental information, the control device 500 sets the number of sheets to be supported in the supporting member 25 and the air flow rate of the blower unit 29 (S48). Thereafter, the control device 500 finishes the printing (S49).

The processing of S48 is specifically described. In the case of having determined that the temperature is <normal temperature>, the control device 500 sets the number of sheets to be supported at N11 sheets and sets the air flow rate at F11 m/sec as set in the processing of S42. In the case of having determined that the temperature is <high temperature>, the control device 500 sets the number of sheets to be supported at N9 sheets and sets the air flow rate at F9 m/sec. Further, in the case of having determined that the temperature is <low temperature>, the control device 500 sets the number of sheets to be supported at N10 sheets and sets the air flow rate at F10 m/sec.

The number of sheets to be supported is set so as to establish a relationship of N9<N11<N10, and the air flow rate is set so as to establish a relationship of F9>F11>F10. As the temperature T is higher, the sheets S are less likely to radiate heat, and accordingly, the mutual adhesion of the sheets is prone to occur. Meanwhile, as the temperature T is lower, the sheets S are more likely to radiate heat, and accordingly, the mutual adhesion of the sheets is less likely to occur. Hence, in the case where the temperature is <high temperature>, the number of sheets to be supported is reduced compared to the case where the temperature is <normal temperature>, and the air flow rate is increased compared to the case where the temperature is <normal temperature>. In the case where the temperature is <low temperature>, the number of sheets to be supported is increased compared to the case where the temperature is <normal temperature>, and the air flow rate is reduced compared to the case where the temperature is <normal temperature>.

The temperature T of the installed printer main body 100A is detected by the environmental sensor 27. Then, based on the information regarding the detected temperature as the environmental information, the number of sheets S to be supported by the supporting member 25 and the air flow rate of the blower unit 29 are set. In such a way, a cooling effect optimal for the temperature of the atmosphere in which the printer main body 100A is placed is obtained. Hence, the mutual adhesion of the sheets on the sheet delivery tray 17 may be reduced.

The description has been made of the case where the environmental sensor 27 is the temperature sensor, and detects the temperature of the atmosphere inside the printer main body 100A. However, it may be a sensor that is installed on the outside of the printer main body 100A, and detects an ambient temperature in the vicinity of the printer main body 100A.

The environmental sensor 27 may be a humidity sensor. In this case, as humidity is increased, it becomes more difficult for the toner to be dried. Accordingly, as the humidity is increased, the control device 500 may reduce the number of sheets to be supported by the supporting member 25, and may increase the air flow rate of the blower unit 29. Meanwhile, as the humidity is decreased, the control device 500 may increase the number of sheets to be supported, and may reduce the air flow rate.

The environmental sensor 27 may include the temperature sensor and the humidity sensor. In this case, more detailed setting becomes possible, and the mutual adhesion of the sheets may be suppressed more effectively.

Sixth Embodiment

Figure 9A:
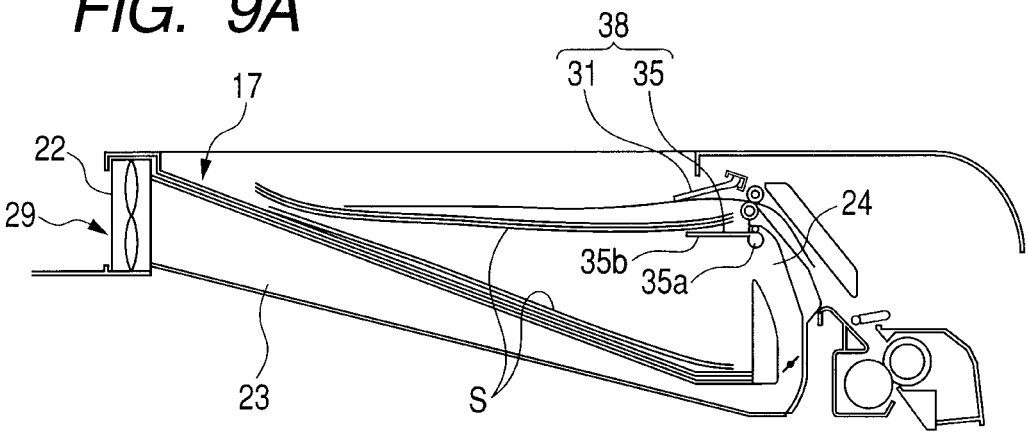
Figure 9B:
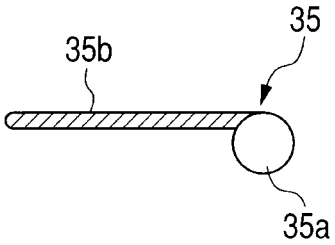
Figure 9C:
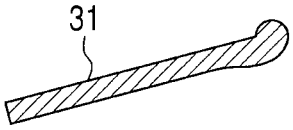
Figure 9D:
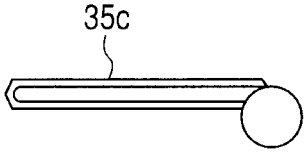
Figure 9E:
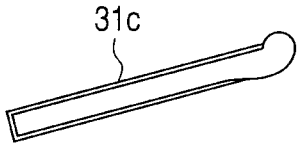
FIG. 9E is an explanatory view of another embodiment.
Figure 10:
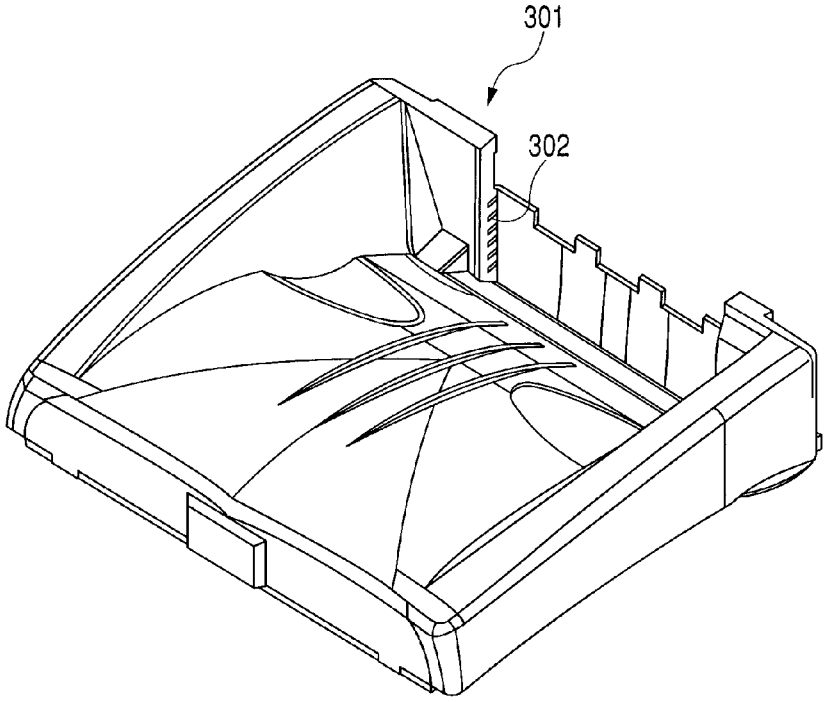
PRIOR ART FIG. 10
FIG. 10 illustrates a sheet delivery tray of a conventional image forming apparatus.
Figure 11:
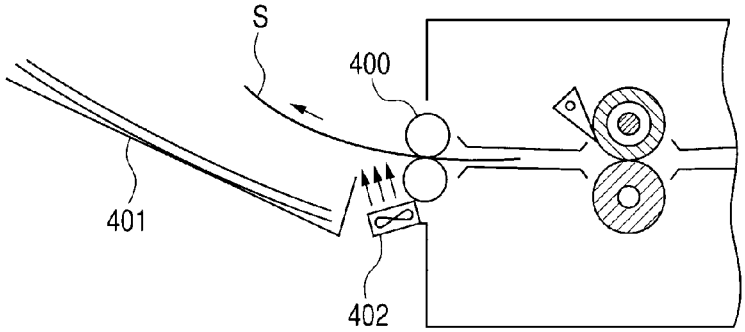
PRIOR ART FIG. 11
FIG. 11 illustrates an image forming apparatus including a conventional blower fan.

In each of the first to fifth embodiments described above, the case where the supporting member 25 and the pressing member 21 are formed of a resin has been described. In the sixth embodiment, a case is described where the supporting member has a highly thermal conductive member, and the pressing member has a highly thermal conductive member. In the description of the sixth embodiment, the same reference symbols and numerals are assigned to similar configurations to those of the first embodiment described above, and descriptions thereof are omitted. FIGS. 9A to 9E are explanatory views illustrating a supporting unit of a printer as an example of an image forming apparatus according to the sixth embodiment of the present invention. FIG. 9A is an explanatory view of principal portions of the printer 100, illustrating operations for delivering the sheets S. FIG. 9B is an explanatory view of a supporting member. FIG. 9C is an explanatory view of a pressing member. FIG. 9D is an explanatory view of a supporting member of another embodiment. FIG. 9E is an explanatory view of a pressing member of another embodiment. In FIG. 9A, a supporting unit 38 includes a pressing member 31 and a supporting member 35. When moved to the first position, the supporting member 35 supports the trailing edge portions of the sheets S together with the pressing member 31, thereby supports the trailing edge portions of the sheets S. At this time, a part of a pivot portion 35*a* of the supporting member 35 and a part of an extended portion 35*b* thereof are always exposed to the air blown out of the blower port 24.

In the sixth embodiment, as illustrated in FIG. 9B, the entirety of the supporting member 35 is formed of the highly thermal conductive member. Further, in the sixth embodiment, as illustrated in FIG. 9C, the entirety of the pressing member 31 is formed of the highly thermal conductive member. The highly thermal conductive members are those obtained by adding carbon or a metal filler to sheets made of a metal (aluminum, copper, or the like) or to a resin.

The trailing edge portions of the sheets S are nipped by the supporting member 35 and the pressing member 31, and accordingly, heat of a portion of the sheet S, which is in contact with the supporting member 35, thermally conducts to the supporting member 35. A part of the supporting member 35 is cooled by being exposed to the air blown out of the blower port 24. As a result, the heat of the trailing edge portion of the sheet, which is supported by the supporting portion 35, may also be exhausted through the highly thermal conductive member by the air blown by the blower unit 29, whereby a more positive cooling effect is obtained, and the mutual adhesion of the sheets stacked on the sheet delivery tray 17 may be reduced.

It also becomes possible to exhaust heat of the trailing edge portion of the sheet, which conducts to the pressing member 31, through the highly thermal conductive member which is exposed to the external air, whereby a more positive cooling effect is obtained, and the mutual adhesion of the sheets stacked on the sheet delivery tray 17 may be reduced.

As illustrated in FIG. 9D, a part of the supporting member may be formed of the highly thermal conductive member. Specifically, a coating film 35*c* made of the highly thermal conductive member may be formed on the surface of the extended portion, and in this case, a similar effect to that in the case where the entirety of the supporting member is formed of the highly thermal conductive member as illustrated in FIG. 9B is exerted.

As illustrated in FIG. 9E, a part of the pressing member may be formed of the highly thermal conductive member. Specifically, a coating film 31*c* made of the highly thermal conductive member may be formed on the surface of the extended portion, and in this case, a similar effect to that in the case where the entirety of the pressing member is formed of the highly thermal conductive member as illustrated in FIG. 9C is exerted.

The present invention has been described based on the embodiments, but the present invention is not limited to these embodiments. In each of the first to fifth embodiments, the description has been made of the case of setting the number of sheets to be supported at the predetermined number of sheets based on one of the pieces of information including the sheet information, the image information, the sheet delivery speed information, and the environmental information. However, the present invention is not limited thereto. The number of sheets to be supported may be set at the predetermined number of sheets based on two or more of the pieces of information. The number of sheets is determined based on the various types of information in combination, whereby more detailed setting becomes possible, and the mutual adhesion of the sheets may be suppressed more effectively.

In each of the first to fifth embodiments, the description has been made of the case of controlling the flow rate of the blower unit 29 based on one of the pieces of information including the sheet information, the image information, the sheet delivery speed information, and the environmental information. However, the present invention is not limited thereto. The flow rate of the blower unit 29 may be controlled based on two or more of the pieces of information. The flow rate is determined based on the various types of information in combination, whereby more detailed setting becomes possible, and it becomes possible to suppress the mutual adhesion of the sheets more effectively. The drive of the blower fan 22 for blowing the air may also be optimized, and effects of reducing the power to drive the fan and reducing the noise may also be expected. If the same information as the information used at the time of setting the number of sheets to be supported by the supporting member is used, then the mutual adhesion of the sheets may be suppressed more effectively.

In each of the first to sixth embodiments, the description has been made of the case where the supporting unit supports the substantial center portions in the width direction of the trailing edge portions of the sheets. However, the present invention is not limited thereto, and the supporting unit may be extended in the width direction, and may support the entirety of the trailing edge portions of the sheets. Unless the sheets are displaced or blown away by the air blown thereto, spots of the sheets, which are to be supported by the supporting unit, may be any of the trailing edge portions of the sheets in the width direction. Unless the sheets supported by the supporting member are blown away by the air blown thereto, a configuration is also possible, in which the pressing member is omitted, and the sheets are not nipped thereby.

In each of the first to sixth embodiments, the description has been made of the case where the air is blown to the planes of the supported sheets, which are the lower surfaces of the sheets. However, the present invention is not limited to such a case, and the air may be blown to the planes of the sheets, which are the upper surfaces or both surfaces of the sheets. In the case of blowing the air to the upper surfaces of the sheets, for example, the blower port may be formed in the vicinity of pressing member. In the case of blowing the air to both surfaces of the sheets, two blower ports, each blowing the air to each surface thereof, may be formed. The supporting unit 28 supports the substantial center portions in the width direction of the trailing edge portions of the sheets S, and accordingly, gaps are formed on both sides thereof in the width direction. A part of the air blown out of the blower port 24 of the blower unit 29 may flow through these gaps along the upper surface of the sheets S.

In each of the first to sixth embodiments, the description has been made of the case where the sheets are directly delivered from the printer main body 100A without being switched back inside the printer main body 100A. However, the sheets may be delivered from the printer main body 100A after being switched back therein. In this case, upstream edge portions of the sheets in the sheet delivery direction after the sheets are switched back are the trailing edge portions of the sheets, and downstream edge portions of the sheets in the sheet delivery direction thereafter are the leading edge portions of the sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-089274, filed Apr. 1, 2009, No. 2010-044330, filed Mar. 1, 2010 which are hereby incorporated by reference herein in their entirety.

What is claimed is:

1. An image forming apparatus comprising:

a transfer unit that transfers a toner image onto a sheet;

a fixing unit that fixes the toner image transferred onto the sheet by heat;

a sheet delivery unit that delivers the sheet on which the toner image is fixed onto a sheet delivery tray;

a supporting member that supports an upstream edge portion of the sheet before the upstream edge portion of the sheet in the delivery direction falls down on the sheet delivery tray, the supporting member being placed between the sheet delivery unit and a sheet stacking surface of the sheet delivery tray;

a pressing member that presses the delivered sheet against the supporting member to nip the upstream edge portion of the sheet;

a blower unit that blows air to a lower surface of the sheet nipped by the supporting member and the pressing member;

a moving unit that moves the supporting member; and a controller that controls the moving unit so that the supporting member moves between a first position to support the upstream edge portion of the sheet and a second position to drop the upstream edge portion of the sheet onto the sheet delivery tray.

2. The image forming apparatus according to claim 1, wherein the blower unit blows air from the upstream edge portion toward a downstream edge portion of the supported sheet in the delivery direction.

3. The image forming apparatus according to claim 1, wherein the controller sets the set predetermined number based on at least one of pieces of information including sheet information, information on an image to be formed on the sheet, information on a delivery speed of the sheet by the sheet delivery unit, and information on an environment in which the image forming apparatus is installed.

4. The image forming apparatus according to claim 3, wherein the controller controls an air flow rate of the blower unit based on the at least one of the pieces of information.

5. The image forming apparatus according to claim 3, further comprising a sheet type detection unit that detects a type of the sheet as the sheet information.

6. The image forming apparatus according to claim 3, wherein the information on the image is information regarding a toner bearing amount in an image region on the sheet.

7. The image forming apparatus according to claim 3, further comprising an environmental detection unit that detects, as the information on the environment, at least one of a temperature and humidity of an atmosphere in which the image forming apparatus is installed.

8. The image forming apparatus according to claim 1, wherein the controller controls the moving unit so that the supporting member releases the supported sheets when the number of the supported sheets reaches a predetermined number.

* * * * *